US008806723B2

(12) United States Patent
Martinson et al.

(10) Patent No.: US 8,806,723 B2
(45) Date of Patent: Aug. 19, 2014

(54) TIE WRAP FOR BUNDLING OBJECTS

(75) Inventors: Daniel J. Martinson, Plymouth, MN (US); Richard N. Case, Boulder, CO (US); Bowden Ormsbee, Longmont, CO (US)

(73) Assignee: Nite Ize, Inc., Boulder, CO (US)

( * ) Notice: Subject to any disclaimer, the term of this patent is extended or adjusted under 35 U.S.C. 154(b) by 351 days.

(21) Appl. No.: 13/196,725

(22) Filed: Aug. 2, 2011

(65) Prior Publication Data

US 2011/0286217 A1 Nov. 24, 2011

Related U.S. Application Data

(63) Continuation-in-part of application No. 12/247,523, filed on Oct. 8, 2008, now Pat. No. 8,387,216.

(51) Int. Cl.
*B65D 63/00* (2006.01)
*F21V 33/00* (2006.01)

(52) U.S. Cl.
USPC ..... 24/343; 24/3.1; 24/3.12; 24/16 R; 24/16 PB; 24/30.5 T; 24/373

(58) Field of Classification Search
USPC ..... 24/3.1, 3.12, 3.6, 16 PB, 16 R, 30.5 T, 24/318, 343, 373
See application file for complete search history.

(56) References Cited

U.S. PATENT DOCUMENTS 1,894,906 A * 1/1933 Henry, Jr. ..... 40/641
2,118,875 A 5/1938 Windheim
2,175,036 A * 10/1939 Sipe ..... 174/84 S
2,224,972 A * 12/1940 Long, Jr. et al. ..... 24/3.6
2,307,808 A * 1/1943 Segal ..... 24/600.6
2,377,688 A * 6/1945 Hubbell ..... 63/20
2,530,695 A 11/1950 Helmert
2,542,601 A 2/1951 Van Cleef
2,581,825 A * 1/1952 Ah Fong Lau Ah You ..... 24/3.6
3,023,483 A 3/1962 Steiner
3,257,054 A 6/1966 Miesel
3,426,393 A 2/1969 Mead
3,458,862 A 7/1969 Franks
3,543,353 A 12/1970 Meehan
3,564,667 A 2/1971 Parrick, III et al.
3,757,429 A 9/1973 Sumino
3,768,711 A 10/1973 Wilkinson (Continued)

OTHER PUBLICATIONS

In the US Patent and Trademark Office U.S. Appl. No. 12/247,523 Non-Final Office Action dated Jan. 31, 2012, 7 pages.

(Continued)

*Primary Examiner* — Robert J Sandy
*Assistant Examiner* — Louis Mercado
(74) *Attorney, Agent, or Firm* — Squire Patton Boggs (US) LLP

(57) ABSTRACT

A twist tie device has an elongated piece of shape-retaining deformable material. A cover covers the shape-retaining deformable material along the length of the elongated piece. The cover has a bond between the elongated piece and the cover. The bond between the cover and the elongated piece is along the entire interior surface of the cover. An outer cover may be bonded to the cover. The outer cover may have a gripping surface and a non-gripping surface. The gripping surface will provide more grip for the twist tie device when it is wrapped around itself, and the gripping surface will provide more grip when it is wrapped around objects.

2 Claims, 18 Drawing Sheets

(56) References Cited

U.S. PATENT DOCUMENTS

| | | | | |
|---|---|---|---|---|
| 3,806,358 | A | 4/1974 | Glander et al. | |
| 3,906,139 | A | 9/1975 | Hiraoka et al. | |
| 3,917,387 | A * | 11/1975 | Ensing | 351/123 |
| 3,947,927 | A | 4/1976 | Rosenthal | |
| 3,960,302 | A | 6/1976 | Mazzoni, Jr. | |
| 4,015,762 | A | 4/1977 | Mendillo | |
| 4,120,437 | A | 10/1978 | Hara | |
| 4,267,768 | A | 5/1981 | Cieslak et al. | |
| 4,463,885 | A | 8/1984 | Ball et al. | |
| 4,483,470 | A | 11/1984 | Cousins | |
| 4,484,378 | A | 11/1984 | Kimura et al. | |
| 4,488,748 | A | 12/1984 | Burkes | |
| 4,531,661 | A | 7/1985 | Santy | |
| 4,540,006 | A | 9/1985 | Collis | |
| 4,553,779 | A | 11/1985 | Shortridge | |
| 4,641,454 | A | 2/1987 | Ray et al. | |
| 4,648,414 | A | 3/1987 | Fox et al. | |
| 4,666,417 | A | 5/1987 | Hillman | |
| 4,679,387 | A | 7/1987 | Weidenhaupt et al. | |
| 4,753,355 | A | 6/1988 | Hall et al. | |
| 4,761,053 | A | 8/1988 | Cogelia et al. | |
| 4,817,837 | A | 4/1989 | Grover | |
| 4,834,118 | A | 5/1989 | Goeller | |
| 4,856,689 | A | 8/1989 | Shore | |
| 4,867,478 | A | 9/1989 | Anderson | |
| 4,915,996 | A | 4/1990 | Curry | |
| D310,909 | S | 10/1990 | Bradtl | |
| 5,054,299 | A | 10/1991 | Maveety | |
| 5,056,820 | A | 10/1991 | Des Prez | |
| 5,104,017 | A | 4/1992 | Vandagriff | |
| 5,154,964 | A | 10/1992 | Iwai et al. | |
| 5,178,354 | A * | 1/1993 | Engvall | 248/316.7 |
| 5,190,336 | A | 3/1993 | Palz | |
| 5,199,135 | A | 4/1993 | Gold | |
| 5,234,370 | A | 8/1993 | Shapero et al. | |
| 5,310,376 | A | 5/1994 | Mayuzumi et al. | |
| 5,342,687 | A | 8/1994 | Iwai et al. | |
| 5,437,401 | A | 8/1995 | Seltzer | |
| 5,468,036 | A | 11/1995 | Brown | |
| 5,498,190 | A | 3/1996 | Ganson | |
| 5,590,422 | A | 1/1997 | Henderson | |
| 5,607,748 | A | 3/1997 | Feltman | |
| 5,664,589 | A | 9/1997 | Black | |
| 5,711,143 | A * | 1/1998 | Munakata et al. | 57/215 |
| 5,714,211 | A | 2/1998 | Zinbarg et al. | |
| 5,769,994 | A | 6/1998 | Booz et al. | |
| 5,827,461 | A | 10/1998 | Feltman | |
| 5,853,212 | A | 12/1998 | Daniel | |
| 5,864,924 | A * | 2/1999 | Rodriguez | 24/3.3 |
| 5,916,006 | A | 6/1999 | Ganson | |
| 6,113,170 | A | 9/2000 | Daniel | |
| 6,114,036 | A | 9/2000 | Rinehart et al. | |
| 6,206,542 | B1 | 3/2001 | Case et al. | |
| 6,237,740 | B1 | 5/2001 | Weatherall et al. | |
| 6,332,052 | B1 | 12/2001 | Luther et al. | |
| 6,372,344 | B1 | 4/2002 | Castellani et al. | |
| D465,292 | S | 11/2002 | Ko | |
| 6,527,482 | B1 | 3/2003 | Stankus | |
| 6,848,663 | B2 | 2/2005 | Olive | |
| 7,011,879 | B1 | 3/2006 | Contreras et al. | |
| D520,526 | S | 5/2006 | Wuest et al. | |
| 7,123,801 | B2 | 10/2006 | Fitz | |
| 7,192,069 | B1 | 3/2007 | Daniel | |
| 7,250,213 | B2 | 7/2007 | Duncan | |
| 7,377,828 | B2 | 5/2008 | Cheung | |
| 7,571,837 | B2 | 8/2009 | Orlowski | |
| D616,292 | S * | 5/2010 | Martinson | D8/394 |
| D669,618 | S * | 10/2012 | Ormsbee et al. | D26/62 |
| D669,619 | S * | 10/2012 | Ormsbee et al. | D26/62 |
| 8,387,216 | B1 * | 3/2013 | Martinson | 24/30.5 T |
| 2002/0028336 | A1 | 3/2002 | Jaccoud | |
| 2002/0118535 | A1 | 8/2002 | Nostrant | |
| 2005/0093205 | A1 | 5/2005 | Martin et al. | |
| 2005/0211357 | A1 | 9/2005 | Ren | |
| 2005/0274211 | A1 | 12/2005 | Edgman | |
| 2008/0124544 | A1 | 5/2008 | Alexander et al. | |
| 2008/0127460 | A1 * | 6/2008 | Severen et al. | 24/3.3 |
| 2008/0223389 | A1 | 9/2008 | Harvie | |
| 2008/0254281 | A1 | 10/2008 | Chen et al. | |
| 2009/0095854 | A1 | 4/2009 | Forbes et al. | |
| 2010/0115732 | A1 * | 5/2010 | Honeycutt | 24/3.3 |
| 2011/0286217 | A1 * | 11/2011 | Martinson et al. | 362/253 |
| 2013/0026316 | A1 * | 1/2013 | Case et al. | 248/205.1 |
| 2013/0032617 | A1 * | 2/2013 | Adelman et al. | 224/191 |
| 2013/0174382 | A1 * | 7/2013 | Martinson | 24/27 |

OTHER PUBLICATIONS

In the US Patent and Trademark Offfice U.S. Appl. No. 12/247,523 Non-Final Office Action dated Jul. 13, 2011, 9 pages.

ACOR, ACOR present Volara 4E, Mar. 2, 2008; http://acor.com/volara.htm.

International Search Report dated Dec. 9, 2011, in related PCT Application No. PCT/US2011/046304, 3 pages.

Web page illustration from web site illustrating Grip Twist lock and carry device; griptwist.com; Dakota Trading corporation, 2008.

Web page illustration from web site illustrating reusable silicone coated Sili Twists; www.wrapables.com; Wrapables, 2008.

In the U.S. Appl. No. 12/247,523 Final Office Action dated Aug. 16, 2012, 11 pages.

In the U.S. Appl. No. 13/784,455 Final Office Action dated Nov. 8, 2013, 11 pages.

In the U.S. Appl. No. 13/784,455 Non-Final Office Action dated May 22, 2013, 9 pages.

* cited by examiner

TIE WRAP FOR BUNDLING OBJECTS

CROSS REFERENCE TO RELATED APPLICATIONS

This application is a continuation-in-part of U.S. patent application Ser. No. 12/247,523 filed Oct. 8, 2008, now U.S. Pat. No. 8,387,216, entitled "TIE WRAP FOR BUNDLING OBJECTS." This application also is related to the US patent application entitled "CASE WITH LIVING HINGE" filed concurrently herewith. The foregoing applications are hereby incorporated by reference to the same extent as though fully disclosed herein.

BACKGROUND

Twist ties are well known in the art and typically are not suitable for supporting weight or bundling large objects. Twist ties often are found on packaging such as bread wrappers. These twist ties are usually a plastic or paper coating that covers a wire within the twist tie. The plastic or paper coating is not bonded to the wire and may be removed easily. Also, the coating provides little grip to the object on which the twist tie is wrapped. The coating does not grip itself well either.

U.S. Pat. No. 6,113,170 shows a wrap for bundling objects that includes a wire covered by a flexible tube, but there is no bonding between the wire and the tube. The invention of that patent also lacks a surface which enhances the grip of the wrap when it is wrapped around itself or other objects.

SUMMARY

Embodiments and configurations including a twist tie device are shown herein. The device has an elongated piece of shape-retaining deformable material. A cover covers the shape-retaining deformable material along the length of the elongated piece. The cover has a bond between the elongated piece and the cover. The bond between the cover and the elongated piece is along the entire interior surface of the cover. An outer cover may be bonded to the cover.

The outer cover may have a gripping surface and a non-gripping surface. The gripping surface will provide more grip for the twist tie device when it is wrapped around itself, and the gripping surface will provide more grip when it is wrapped around objects. A non-gripping surface being generally smoother than the gripping surface is suitable for containing indicia.

In one embodiment, a method of making a twist tie device includes providing an elongated piece of shape-retaining deformable material and heating the shape-retaining deformable material. The method includes coextruding a cover to surround the elongated piece of shape-retaining deformable material so that a bond is formed between the shape-retaining deformable material and the cover. The method includes injection molding an end cap beyond a length of the elongated piece of shape-retaining deformable material.

In one embodiment, a holder includes a body and a cylindrical holder interconnected with the body. The holder further includes a tie comprised of an elongated piece of shape-retaining deformable material and a cover covering the shape-retaining deformable material along the length of the elongated piece; the covering and the shape-retaining deformable material being bonded along their length; the tie located in the cylindrical holder; and the cylindrical holder having a first circular cross-section approximately equal to a second circular cross-section of the tie. Optionally, the cylindrical holder includes an aperture along a length of the cylindrical holder, the aperture more narrow than a width of the tie, such that when compressed the tie may be moved through the aperture releasing it from the cylindrical holder. Alternatively, the body includes a slot for receiving a clip. In one alternative, the body is integrated into the housing of an object. Optionally, the body includes a connection mechanism for attaching to another object. In one alternative, a plurality of cylindrical holders is attached to the body, the cylindrical holder being one of the plurality of cylindrical holders. Optionally, the body has a first and second edge; the first and second edge opposite each other and parallel to each other; the cylindrical holder located on the first edge; the cylindrical holder having a first length parallel to the first circular cross section; the first length of the cylindrical holder parallel to the first edge; a second cylindrical holder of the plurality of cylindrical holders located on the second edge; the second cylindrical holder having a third circular cross-section and a second length parallel to the third circular cross section; and the second length of the second cylindrical holder parallel to the second edge. Alternatively, the tie is located in the second cylindrical holder and a first portion of the tie stretches between the cylindrical holder and the second cylindrical holder; a second portion of the tie extends from the cylindrical holder opposite the first portion; and a third portion of the tie extends from the second cylindrical holder opposite the first portion. Optionally, the first portion of the tie is bent away from the body in order to form a support structure in conjunction with the body. In one alternative, the second and third portions of the tie are bent approximately perpendicular from the body for insertion into a gap. In another alternative, the gap is a vent of a car. Optionally, the body has a first and second side; the first and second sides are opposite each other; the cylindrical holder is located on the first side; the cylindrical holder having a first length parallel to the first circular cross section; a second cylindrical holder of the plurality of cylindrical holders located on the second side; the second cylindrical holder having a third circular cross-section and a second length parallel to the third circular cross section; and the second length of the second cylindrical holder parallel to the first length of the cylindrical holder. Alternatively, the body includes a cavity for a lighting module. Optionally, the holder further includes a cap configured to cover the cavity. Alternatively, a third side of the body opposite the cap is curved to mimic the shape of a bar. Optionally, the bar is part of a bike.

In another embodiment, an attachable lighting device includes a lighting device having a body and an aperture in the body. The attachable lighting device further includes a tie comprised of an elongated piece of shape-retaining deformable material and a cover covering the shape-retaining deformable material along the length of the elongated piece; the covering and the shape-retaining deformable material being bonded along their length; and the tie attached to the lighting device via the aperture wherein the tie is coiled around itself after passing through the aperture.

DETAILED DESCRIPTION

Figure 1:
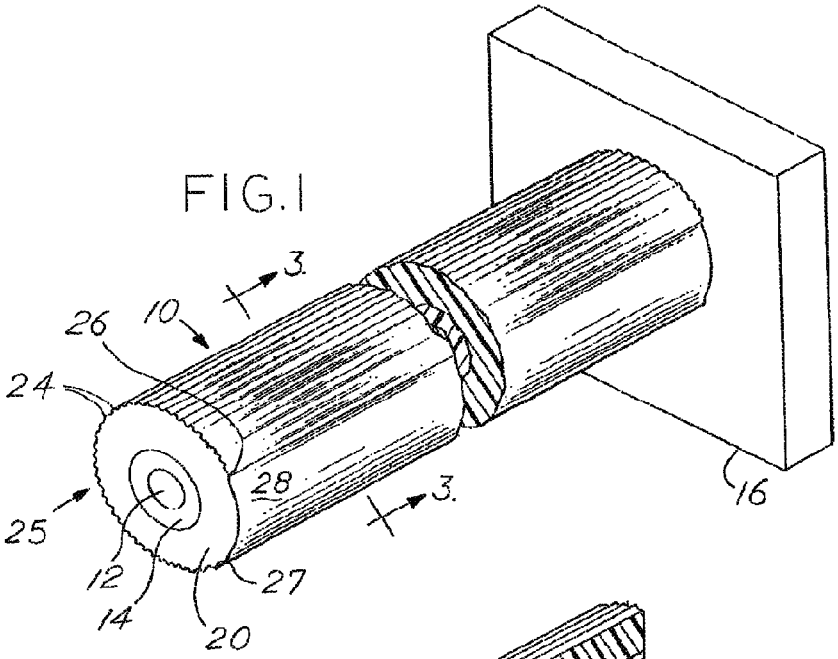
FIG. 1 is a perspective sectional view of the twist tie device.
Figure 2:
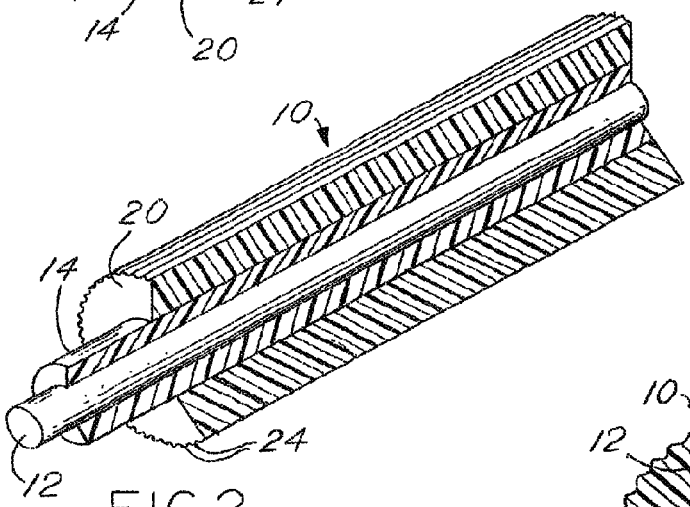
FIG. 2 is a perspective sectional view of the device shown in FIG. 1.

One embodiment of a twist tie device 10 includes an elongated piece of shape-retaining deformable material, which is typically a metal wire 12. The wire 12 is typically a mild steel wire. The wire 12 will be flexible enough to be bent or tied into a particular shape necessary to accomplish a task but still rigid enough to retain a shape into which it is bent. The diameter of the wire 12 also affects flexibility and shape retention. A diameter of 0.62 inches (smaller size ties use an 18-gauge wire; larger ties use a 16-gauge wire) provides both flexibility and necessary shape retention; however, other diameters may be used depending on the application for which the twist tie device 10 will be used. A cover 14 is bonded to the wire 12 along its entire length. The cover is formed by coextruding the wire 12 through an extrusion head 16 along with a polymer. The wire 12 first is heated to approximately 300° F. to 400° F. and then drawn through the extrusion head 16. As the wire 12 moves through the extrusion head 16, a layer of thermoplastic polymer is deposited evenly around the wire 12 to form a tie layer (cover) 14 between the wire and the outer flexible TPE cover. During this process, the polymer forming the tie layer (cover) 14 adheres to the wire 12 via a chemical in it which bonds to the wire. This forms a bond around the entire perimeter of the wire 12 and along the entire length of the wire 12. The bond prevents the wire 12 from slipping out of the cover 14. The polymer used to make the tie layer (cover) 14 is typically a solid thermoplastic polymer, such as 85A Duro Exxon Santoprene 8291-85TL or a similar type of polymer. Santoprene is a thermoplastic vulcanizate and is particularly well suited as a cover 14 material because it is formulated to bond to metal; however, any "thermoplastic" resin can be used that has a chemical bonding agent formulated with the resin to bond to metal. Although, the bonding may not function as well, thermoplastic vulcanizate can be used. The durometer of the Santoprene cover 14 is 85A, which is fairly tough yet flexible. An advantage of using a solid polymer such as Santoprene is that it is resilient.

In one embodiment, the twist tie device includes an internal wire. The wire has a "bonding agent polymer" on it that bonds the wire to the outer layer of TPE (thermoplastic elastomer). Putting an extremely flexible rubber on top of wire 12 without a bond would allow the rubber to slide off. During preparation, the coated wire 12 is heated to accomplish three things:

1. It helps bond the wire to the rubber quicker during the process, which allows for a more consistent part.
2. It prevents the wire from acting as a heat sink as it is pulled through the extrusion die.
3. It lubricates the wire as it goes through the die, helping to prevent surging and sticking inside the die, which makes a better, more consistent part.

Further, an end cap 750 (see FIG. 7) may be injection molded so that there is a polymer bond to the wire cover as part of the formation process. This provides for an integrated end cap 750, improving the life and usefulness of the twist tie 10. The twist tie 10 is placed in a mold to accommodate the molding of the end caps and injection molded.

Figure 3:
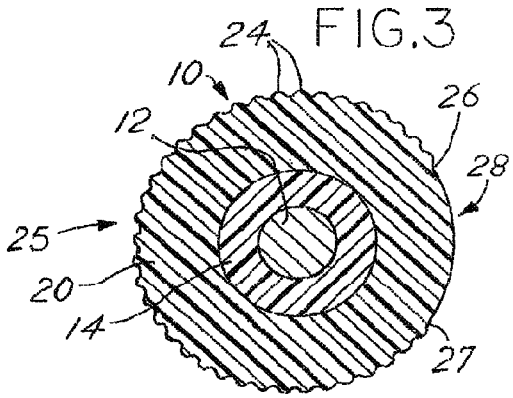
FIG. 3 is a sectional view taken about the line 3-3 in FIG. 1.

An outer cover 20 can be coextruded over the cover. This outer cover 20 is typically a different material than the cover 14. The material of the outer cover 20 is typically softer and of a lower durometer. A suitable material for the outer cover 20 is 15A Duro Teknor Apex Uniprene UN-2005 TPV. Uniprene TPV is a cross-linked elastomeric phase solid thermoplastic polymer. The lower durometer of the outer cover 20 provides a high friction surface. The generally high friction of the outer cover 20 may be increased further by extruding ribs 24 into the outer surface as shown in FIG. 3 to define a texturized gripping surface 25. Although ribs are shown, in alternative embodiments, no ribs may be used or ribs of various shapes may be used, including those that curve, weave, or are oriented in different directions. The gripping surface 25 extends between points 26 and 27 on the left side of the twist tie device 10 as shown in FIG. 3. The gripping surface 25 is well suited to provide a strong grip when the twist tie device 10 is wrapped around itself and provides friction when the device is wrapped around objects. The texturized gripping surface 25 may have other embossed patterns that provide a texturized surface; however, ribs 24 are well suited to the extrusion process by which the twist tie device 10 is made. A non-gripping surface 28 extends between points 26 and 27 on the right side of the twist tie device as shown in FIG. 3. The non-gripping surface 28 is characterized by a smoother texture than the gripping surface 25. Indicia, such as logos or other labels, may be placed on the non-gripping surface 28 and will be easier to read than if placed on the gripping surface 25. In an alternative, a 35 a durometer TPE called Monprene from Teknor Apex for the larger gear ties and a 50 shore a Monprene for the smaller gear ties is used. End caps are made of the 50 a durometer Monprene. If any polymer that is harder than 35 a to 40 a durometer for the large gear ties is used, the ties may not bend and grip properly. The material "seats" into itself more effectively when the above durometer materials are used and the ties are twisted to create a strong hold. This is not as impactful with smaller ties due to the fact that they hold lighter loads. The 15 a durometer Uniprene may not have the same functional characteristics because it may be too soft for the tie and the material's tensile and tear strength is too low.

The cover 14 and outer cover 20 are bonded tightly so that no water may enter between the wire 12 and either cover 14, 20. However, the ends of the wire 12 are not protected by either cover 14, 20. The ends of the wire may be coated with a protective paint or clear coat to prevent corrosion of the ends of the wire 12, but this is not necessary. In an alternative, end caps are molded on the product.

Figure 4:
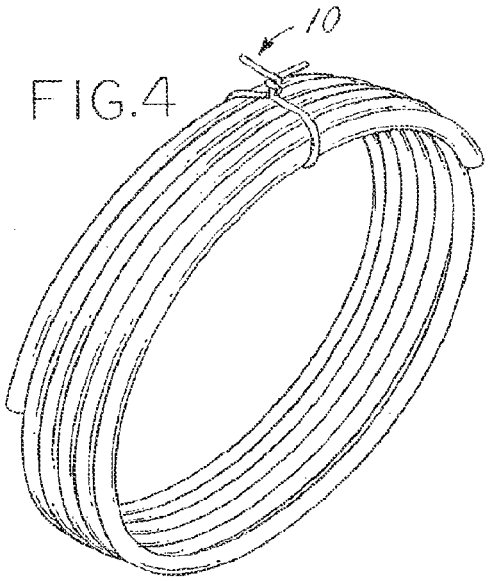
FIGS. 4-6 show embodiments of a twist tie used to bundle various objects.
Figure 5:
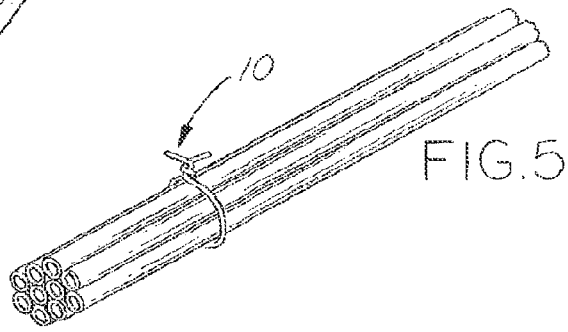
Figure 6:
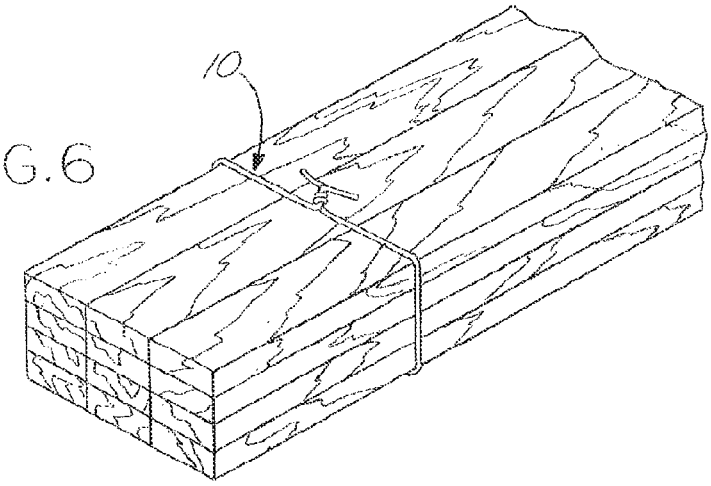

The twist tie 10 may be used by beginning with the twist tie 10 in a generally straightened position. Articles to be bundled can be gathered into manageable bundles as shown in FIGS. 4-6. The twist tie 10 may be wrapped around each bundle of articles and then twisted to form loops around each bundle. The outer cover 20 will provide a high friction gripping surface that will prevent articles contacting the twist tie 10 from sliding out of the twist tie 10. The soft outer cover 20 will not scratch surfaces of articles within the twist tie 10. The twist tie 10 can be left in its twisted position around bundled articles for as long as necessary. The resilient cover 14 and outer cover 20 will resist taking a permanent set due to being compressed due to twisting the twist tie 10 together, or compression due to pressure exerted on the articles within the twist tie 10. Due to the durable construction of the twist tie 10, it may be used effectively in temperatures from −50° F. to 200° F. Additionally, the covers 14, 20 will prevent the twist tie 10 from breaking if the wire 12 were to break because the bond between the cover 14 and the wire 12 will prevent the wire 12 from exiting the covers 14, 20. The integration of the bonded inner and outer cover to the wire core, the outer textured surface, and the end caps provide for an extremely useful tie. Due to the bonding of the inner and outer cover to the wire core, the tie acts as a single piece of material. Therefore, when bending and twisting the tie, a firm hold is established and the slippage of the material of the tie between itself is reduced. The outer textured surface adds to the gripping function as well. The end caps provide for enhanced hold and gripping as well, as they can be inserted into various channels or holes. The ridge that is at approximately a right angle between the main body of the cord and the end cap can be used to catch against surfaces, providing an enhanced grip or hold.

Figure 7:
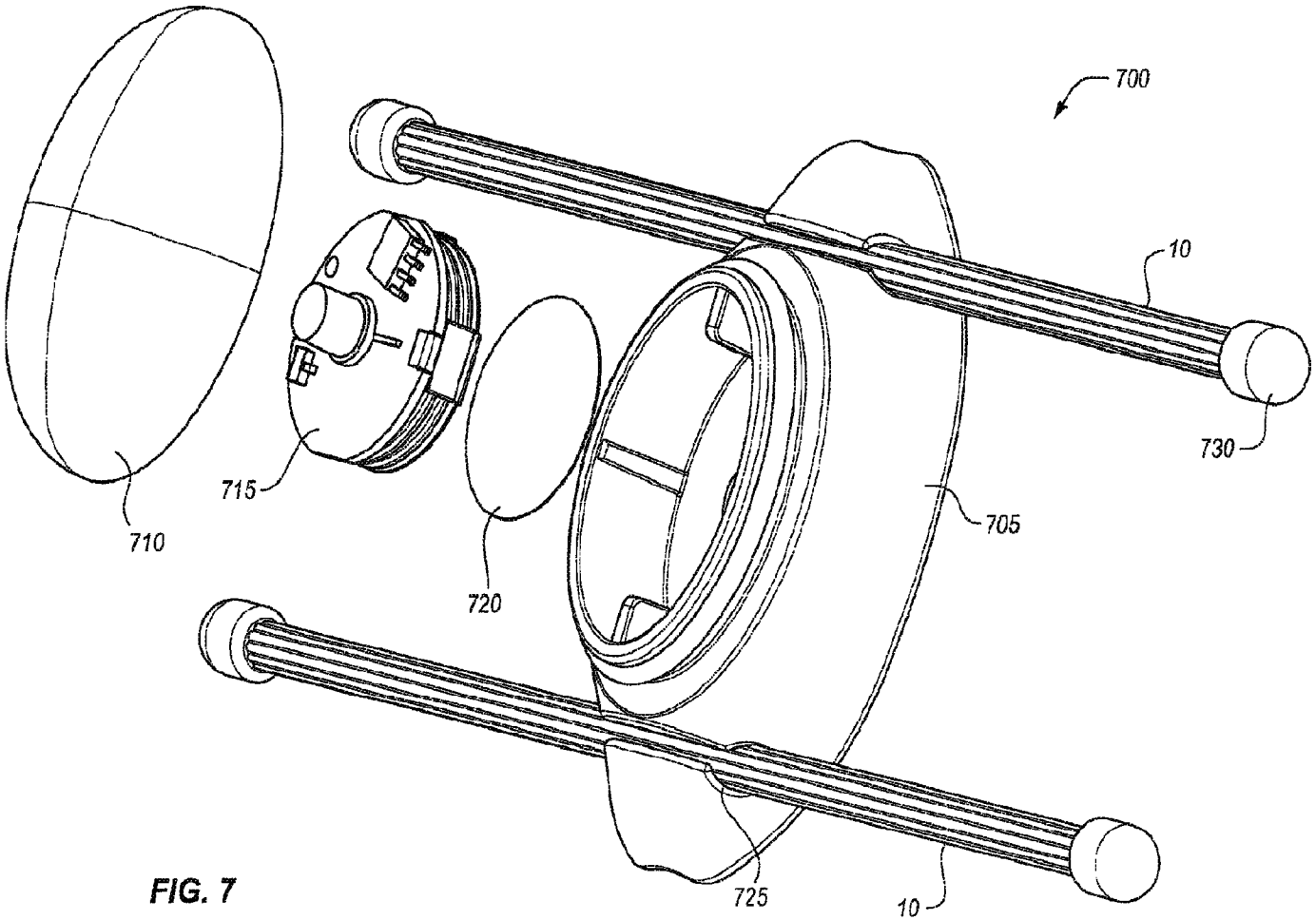
FIG. 7 shows an embodiment of a lighting device with integrated twist ties.

FIG. 7 shows an embodiment of a lighting device with integrated twist ties 10. Lighting device 700 includes body 705, cap 710, lighting mechanism 715, and battery 720. Body 705 has two grooves 725 each for receiving a twist tie 10. Grooves 725 have a diameter that is approximately equal to the cross-sectional diameter of twist ties 10. The opening of the grooves is less than the diameter of the twist ties 10. Twist ties 10 may be inserted into grooves 725 (as shown) through a combination of compressing the rubberized coating and the body 705. In many embodiments, body 705 is some form of plastic. Optionally, some or all of body 705 may be translucent. Optionally, some or all of body 705 may be transparent. Optionally, some or all of cap 710 may be translucent. Optionally, some or all of cap 710 may be transparent. Various embodiments integrating the twist ties may be referred to as holders, receivers, attachment and attachment mechanisms, receiving attachments, etc.

Figure 8B:
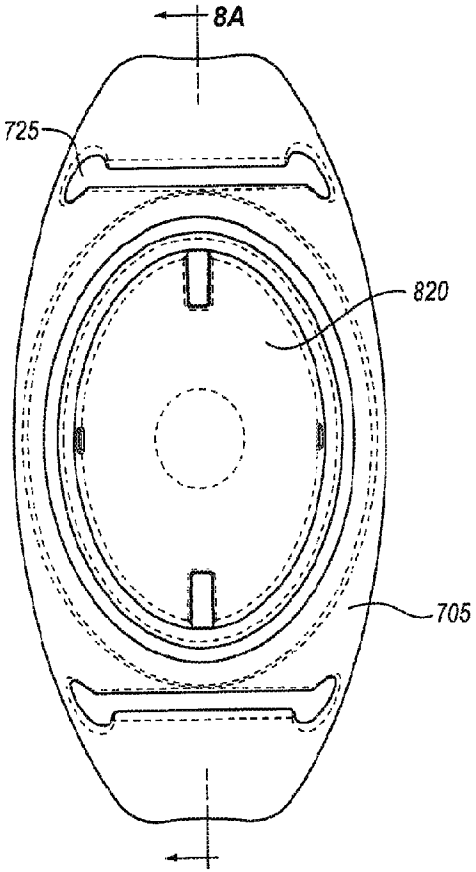
FIG. 8B shows a top view of the body of the lighting device of FIG. 7.
Figure 8A:
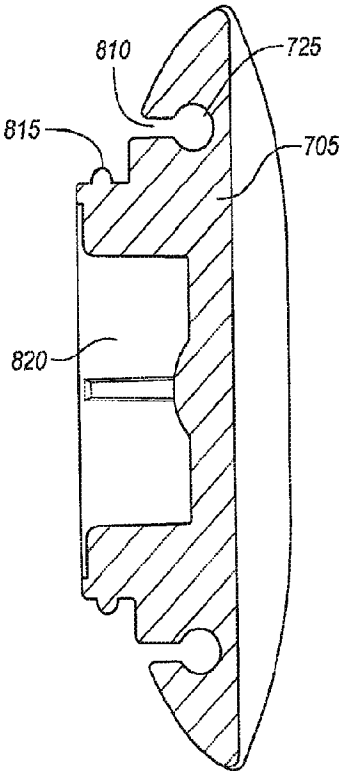
FIG. 8A shows a cross-section of the body of the lighting device of FIG. 7.

FIG. 8A shows a cross-section of the body 705. In this example, the to-scale drawing shows the relative width of the groove 725 to the opening 810. Also visible is lip 815 for the snap fit attachment of cap 710. The positioning of electronics housing 820 also is shown. FIG. 8B shows a top view and some of the same features. The dimensions of these to-scale drawings are only exemplary, and various widths and shapes may be employed. The ratio of the groove to the opening only needs to be sufficient to prevent the twist tie 10 from releasing under normal use. Another feature of the twist tie 10 is the end caps 750 that are extruded as part of the formation process such that the tie body 755 and the end caps 750 are one piece of material. This ensures sound attachment. These end caps 750 prevent the twist tie 10 from slipping out in the longitudinal direction.

Figure 9:
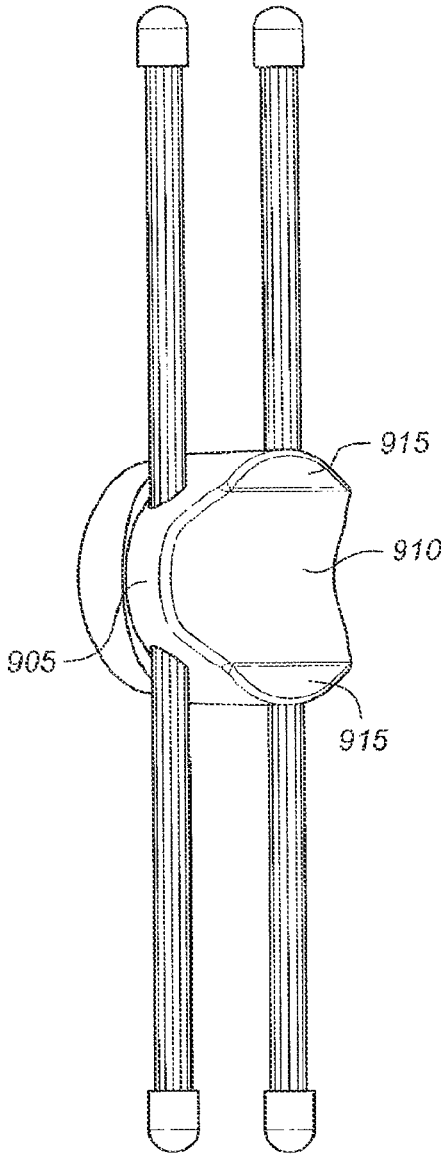
FIG. 9 shows a back view of the body of the lighting device of FIG. 7.
Figure 10:
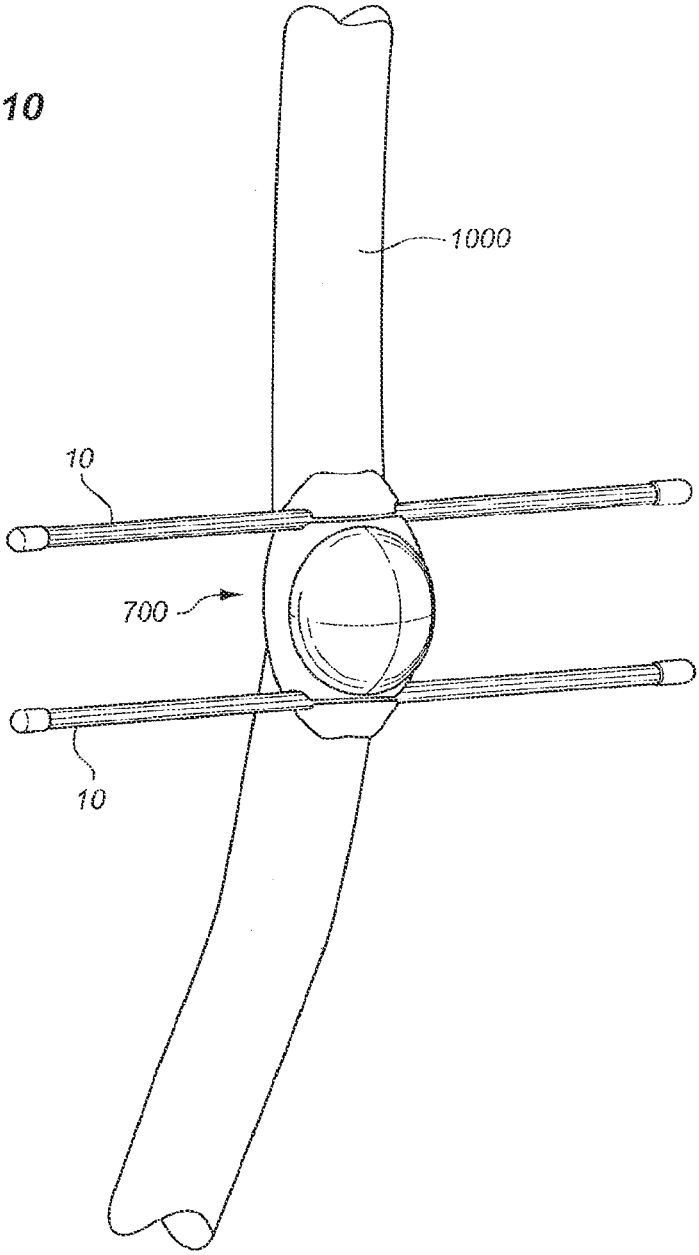
FIG. 10 shows the lighting device of FIG. 7 on a tube.

FIG. 9 shows a view of the back of body 705. Body 705 has a curved surface 910 with a lip 915 on either end. The curved surface 910 is shaped to conform to a tube-like structure. This is shown in FIG. 10 with lighting device 700 situated on a tube 1000. This configuration is designed to fit on the tubes forming the structure of a bike, scooter, or other vehicle or object having tube-like supports. After placing the lighting device on the tube 1000, the twist ties 10 are wrapped around the tube 1000 forming a secure attachment.

Figure 11:
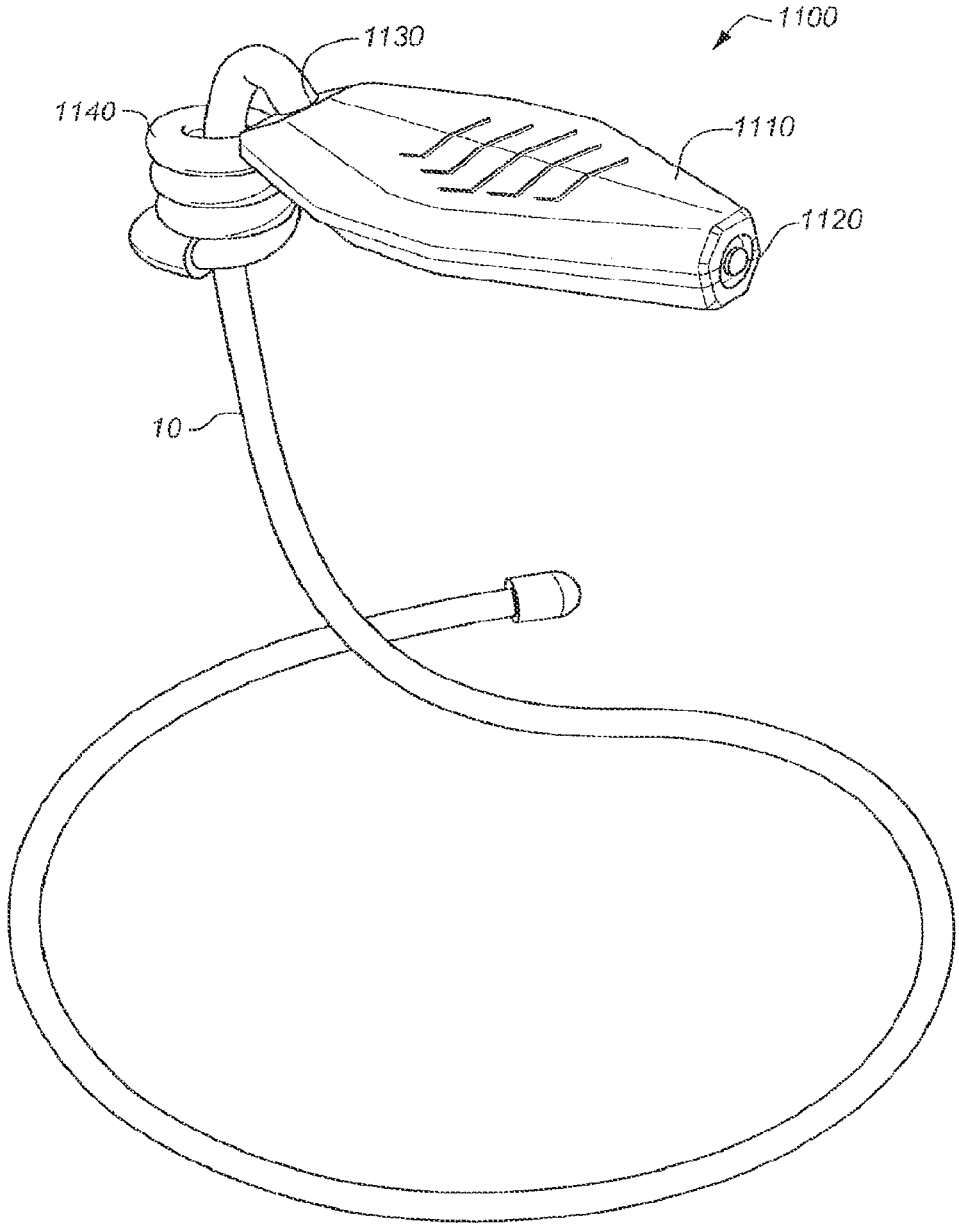
FIG. 11 shows an embodiment of the twist tie integrated with a lighting device.

FIG. 11 shows an embodiment of twist tie 10 integrated with a lighting device 1100. Lighting device 1100 generally includes a housing 1110 and a light 1120. Housing 1110 houses the electronics and power source of the light. Housing 1110 includes an aperture 1130 approximately the size and shape of a cross section of the twist tie 10 (although various sized apertures are appropriate). Twist tie 10 is passed through aperture 1130 and then coiled around itself forming coil 1140. This provides a secure connection. The loose end of twist tie 10 then may be arranged as shown to offer support to lighting device 1100. Lighting device 1100 is sufficiently light in weight, such that the rigidity of twist tie 10 may support it. The loose end of twist tie 10 may be tied around various objects and used to pose lighting device 1100 in a position convenient to the user. The frictional surface of twist tie 10 provides high friction and good hold around a variety of objects. The lighting device shown is the Inova® Microlight™; however, many different lighting devices may be substituted.

Figure 12:
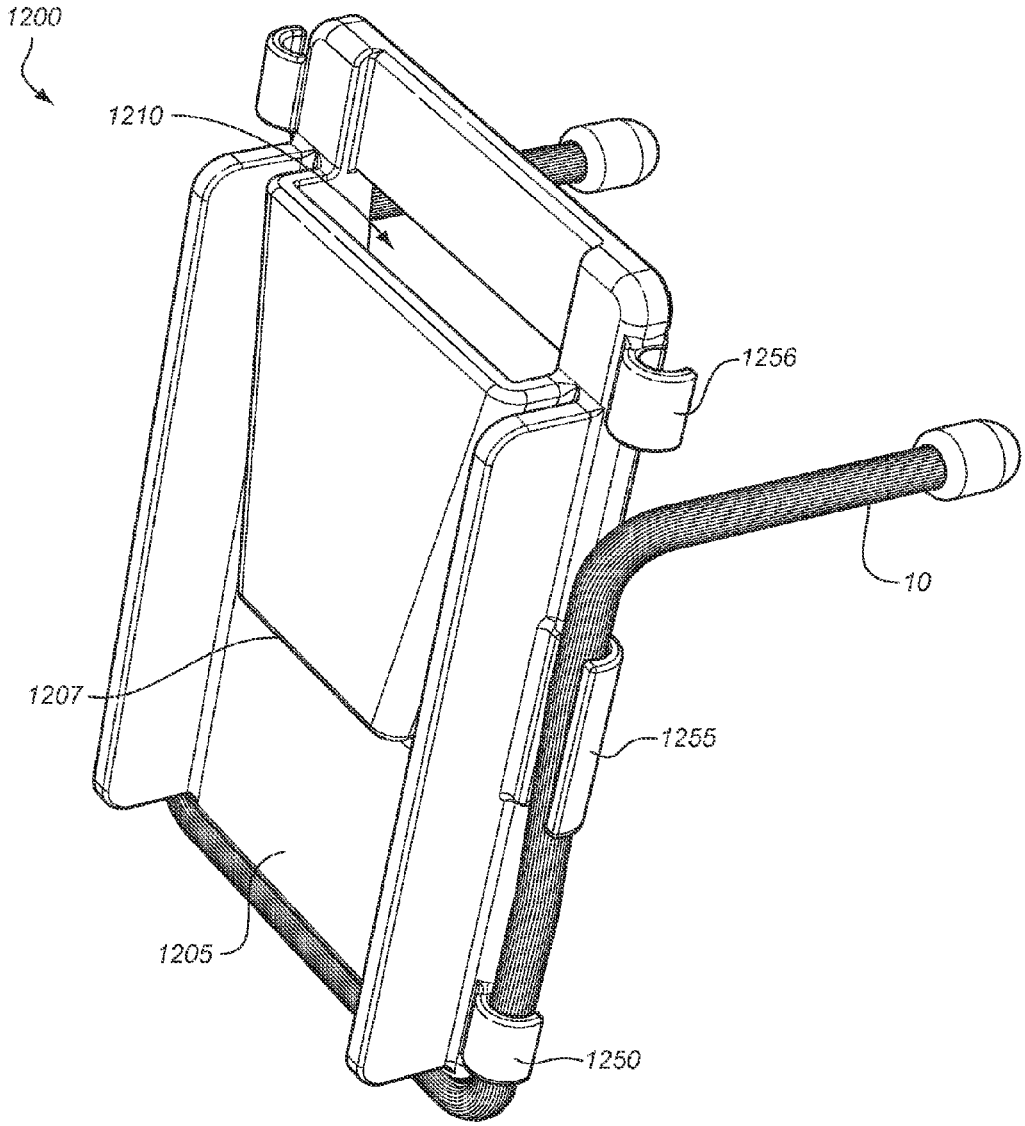
FIG. 12 shows an embodiment of a receiving attachment including twist ties for insertion into the vent of a vehicle.
Figure 13:
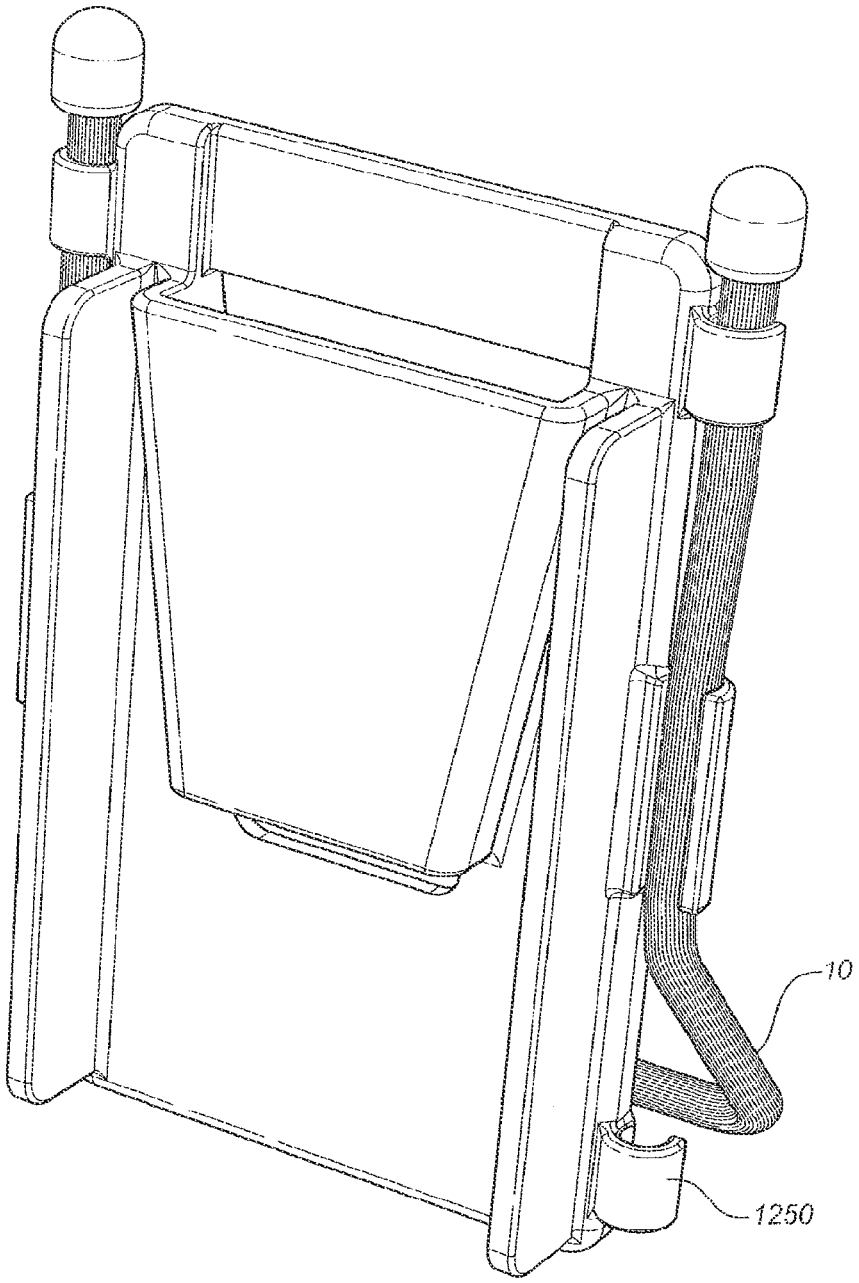
FIG. 13 shows the receiving attachment of FIG. 12 arranged as a stand.

FIG. 12 shows receiving attachment 1200 for integrating with an object bearing a clip or other protrusion. The clip portion of a device or case may be sized to integrate into clip aperture 1210 oriented in body 1205. In some embodiments, the clip portion may include a tab at the bottom 1207 for locking a clip into clip aperture 1310. Cylindrical holders 1255, 1256 include an aperture that is less than the width of twist tie 10 such that the cylindrical holders 1255 flex and bend as does the twist tie 10 to receive twist tie 10 and hold it firmly in place. Cylindrical holders 1255, 1256 open in different directions in order to provide for ease of use and flexibility. This configuration may be advantageous in that the receiving attachment 1200 may be mounted in a car vent or other area using the configuration shown in FIG. 12. As shown in FIG. 13, by bending twist tie 10 away from bottom cylindrical holders 1256, an upright stand is formed. In the above embodiments including a twist tie, both ends of the twist tie may be bent around a bar (such as the handle bars of a bike or other object), as above with lighting device 1100. The cylindrical holders may be oriented in a variety of positions, and a variety of number of holders may be utilized. Various other receiving mechanisms may be substituted for clip aperture 1310. Cylindrical holders 1255, 1256, body 1205, and twist tie 10 may be formed to fit with a variety of objects by forming connection mechanisms on any side of the body. Cylindrical holders 1255, 1256 and body 1205 may be formed as part of the housing of various objects such as cases, flashlights, electronic devices, and virtually any object having a plastic housing. Twist tie 10 then may be fitted into cylindrical holders 1255, 1256, enabling attachment to almost any object that the twist tie 10 may fit around or into. The cylindrical holders 1255, 1256 are not limited to those shown in FIGS. 10, 13, and 14; and various holders for twist tie 10 may be implemented in a variety of positions and configurations.

Figure 14:
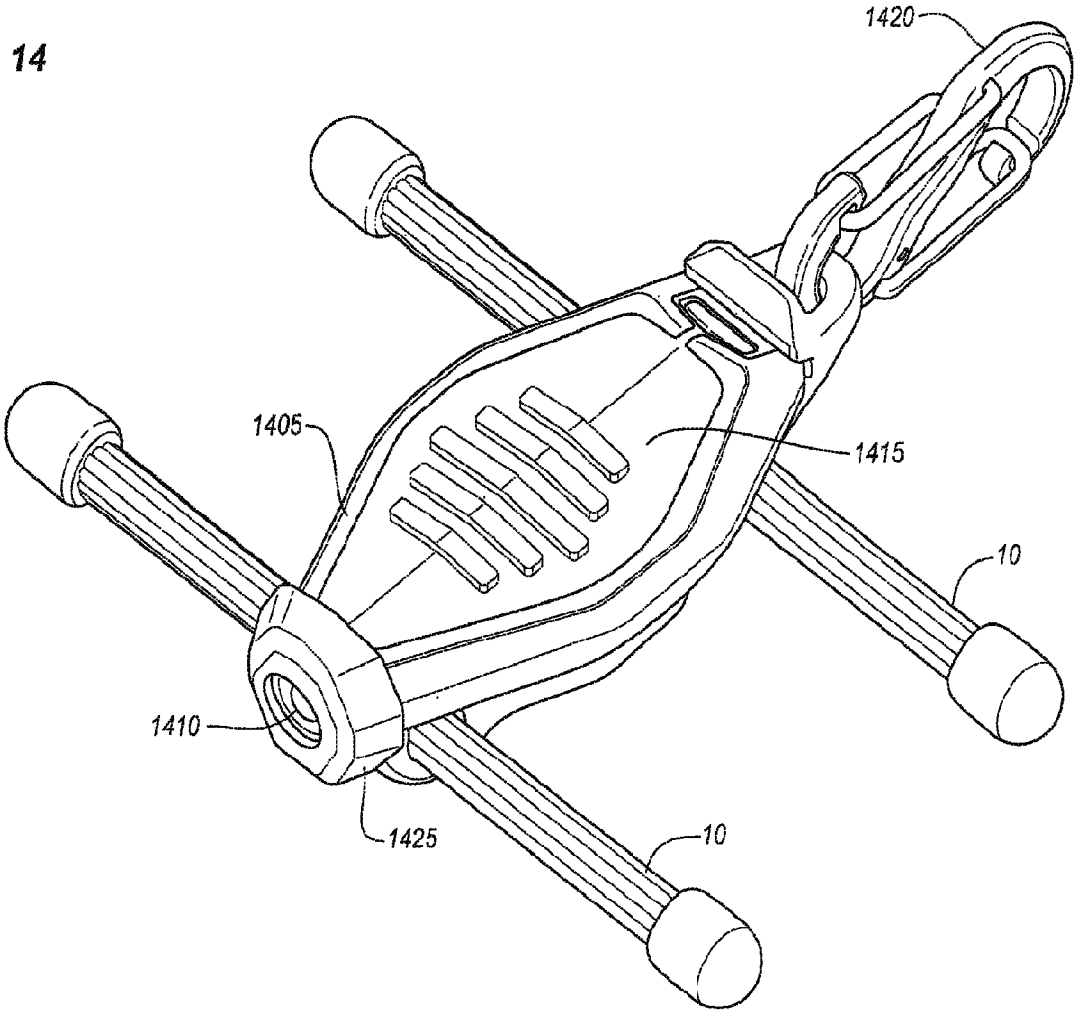
FIG. 14 shows a top perspective view of an embodiment of a lighting device incorporating ties.
Figure 15:
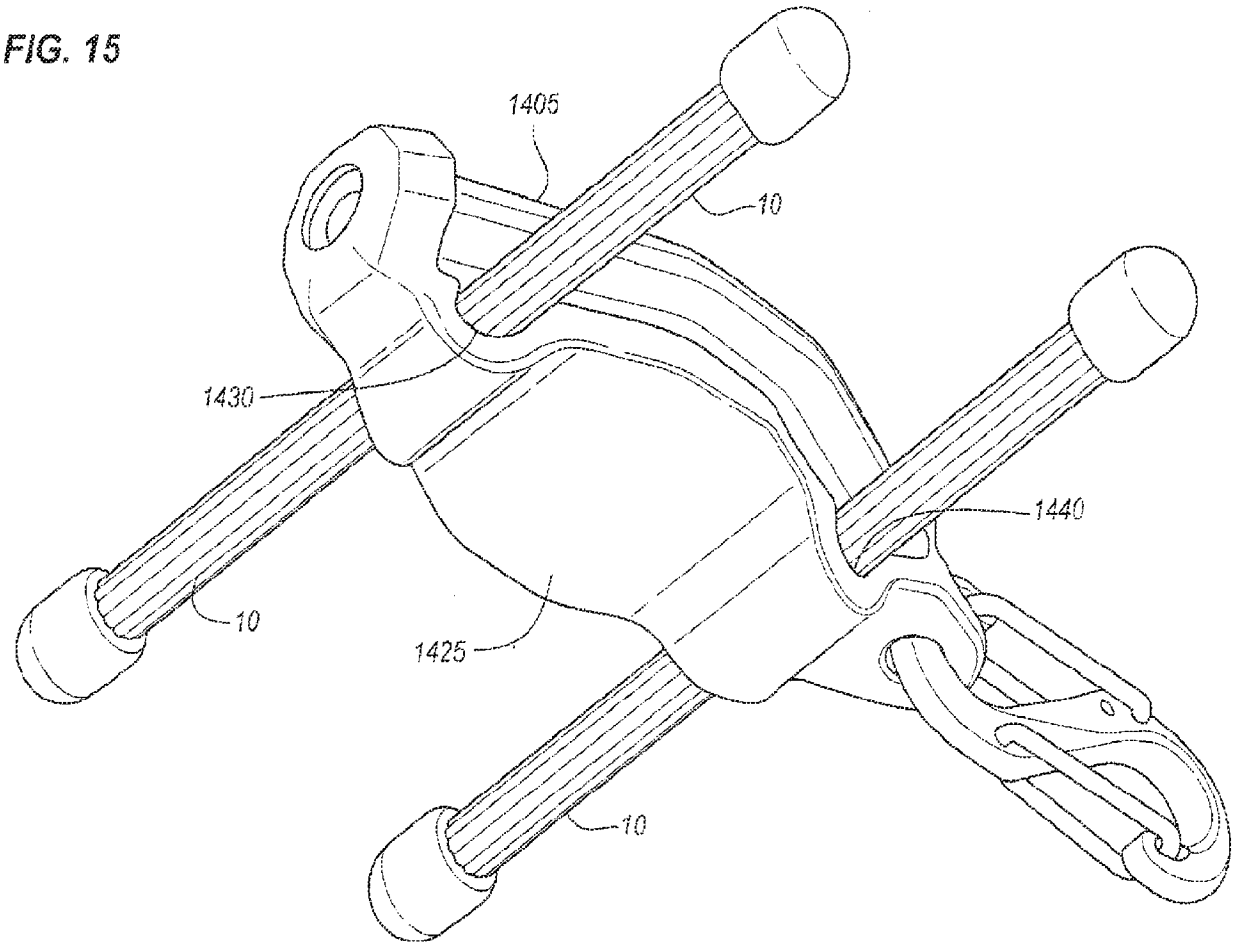
FIG. 15 shows a bottom perspective view of the lighting device of FIG. 14.
Figure 16:
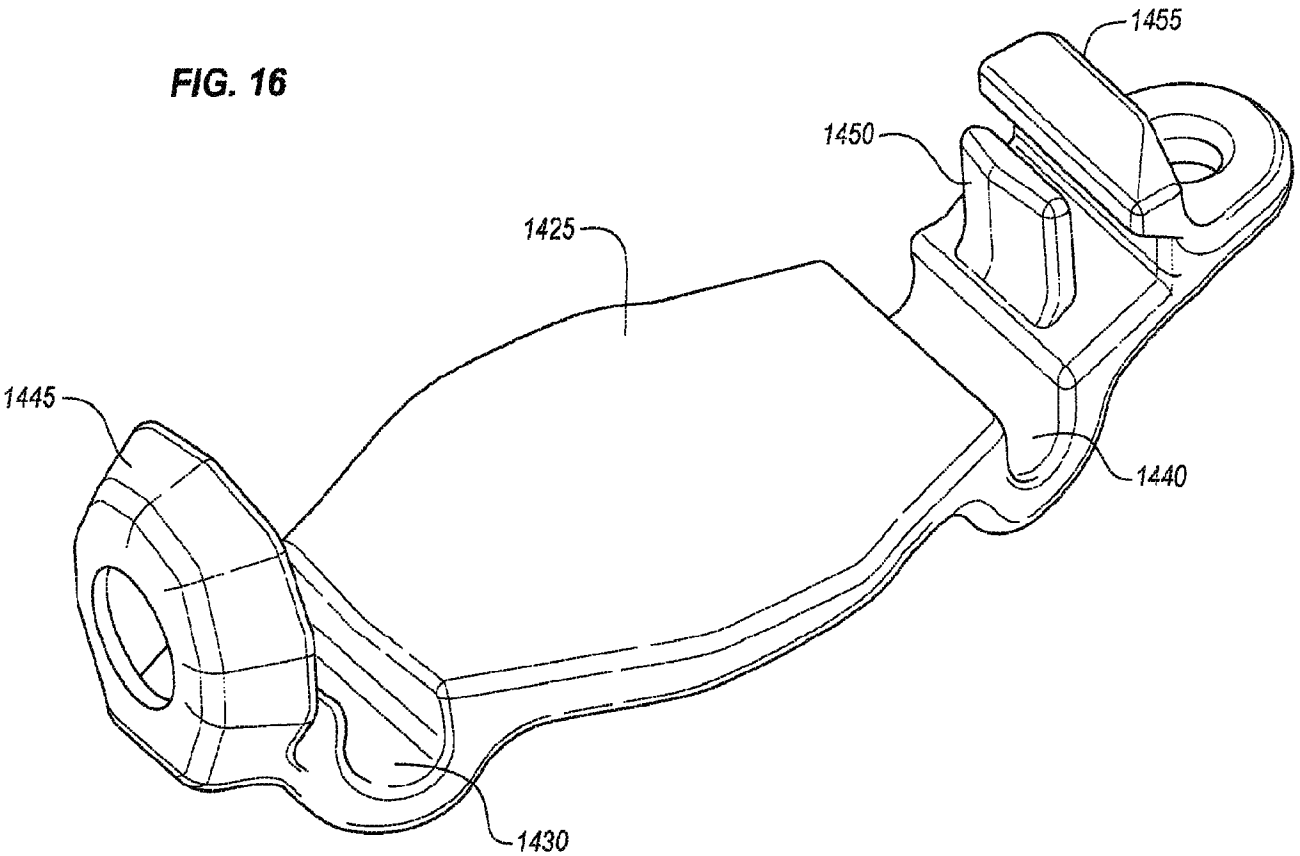
FIG. 16 shows a lower body portion of the lighting device of FIG. 14.

FIG. 14 shows yet another embodiment of an apparatus incorporating a twist tie 10. This embodiment includes a microlight, an S-Biner®, and a first and second twist tie 10. The device includes LED 1410 (which in alternatives can be a different light-providing mechanism), upper body 1405, actuator 1415, lower body portion 1425, and S-Biner® 1420. FIG. 15 is a view from the bottom of the lighting apparatus. The lower body portion 1425 that includes tie seats 1430 and 1440 is shown. FIG. 16 shows the lower body portion 1425 with the other portions removed. Clearly visible are the tie seats 1430 and 1440 which are shaped and sized to hold twist ties 10. The front upper body 1405 slides into front lower body portion 1425, and then a rear portion snaps into place by deflecting front snap fit tab 1450 and rear snap fit tab 1455. In this way, the upper body containing a lighting mechanism can be mounted on one of twist ties 10 placed into tie seats 1430 and 1440. Caps 710 prevent twist ties 10 from sliding out. Twist ties 10 may be bent to stand the apparatus upright or attach it to various objects, as well as using S-Biner® 1420 to hook the device to various objects. S-Biner® 1420 is a device having a carabineer gate on either side, although a regular carabineer or other hooking device may be substituted in alternatives. Various other body forms may be made to hold twist ties 10, those body forms including one or more seats or grooves to hold twist ties 10.

Figure 17:
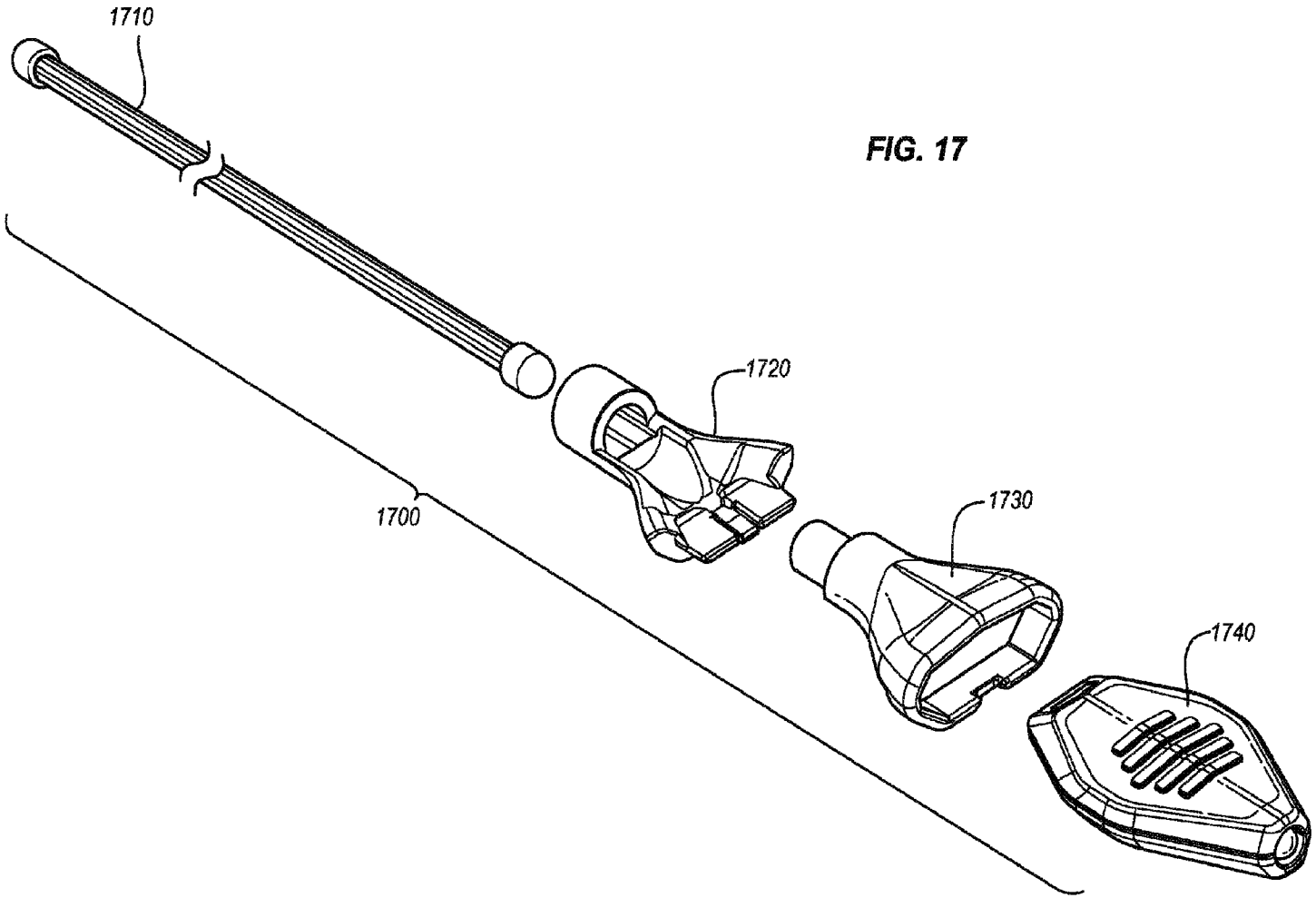
FIG. 17 shows a top perspective view of one embodiment of a lighting device.

FIG. 17 shows a top perspective view of one embodiment of a lighting device 1700. This lighting device provides for a microlight 1740 to be removable attached to a twist tie 1710 similar to as in FIG. 14. Lighting device 1700 includes a first attachment piece 1720 and a second attachment piece 1730.

Figure 18A:
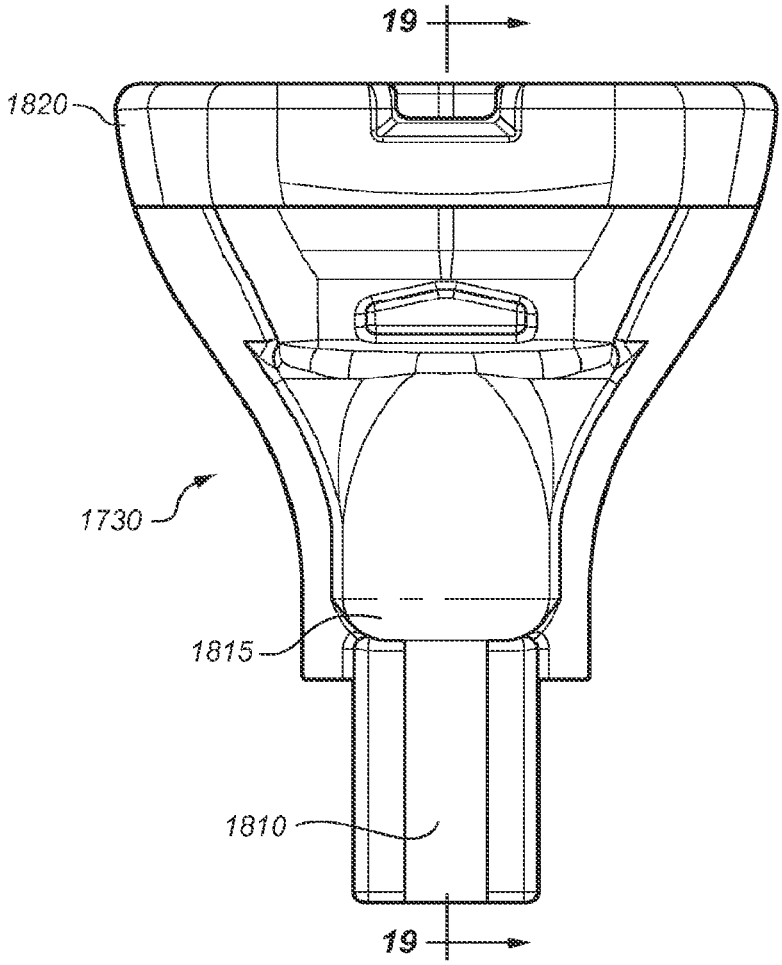
FIG. 18A shows a side view of one-half of a connection device of the lighting device of FIG. 17.
Figure 18B:
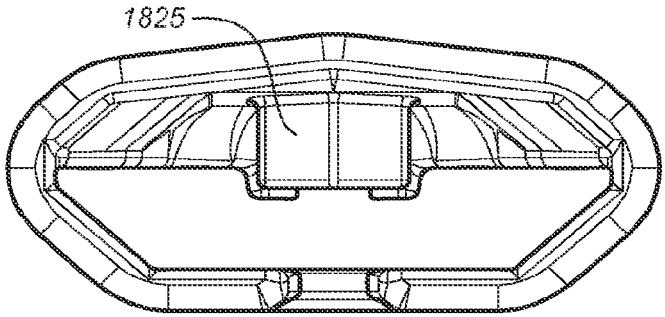
FIG. 18B shows a front view of one-half of the connection device of the lighting device of FIG. 17.

FIG. 18A shows a side view of one-half of a connection device of the lighting device of FIG. 17, and FIG. 18B shows a front view of one-half of the connection device of the lighting device of FIG. 17. Second attachment piece 1730 is typically made of molded plastic; however, other materials such as metal may be used. Second attachment piece 1730 includes an open end 1820 for receiving microlight 1740. Slot 1810 is sized to match the radius of twist tie 1710 which has a capped end that approximately fits in slot 1815. When first attachment piece 1720 and second attachment piece 1730 are integrated, the end cap of twist tie 1710 is held in place by narrower slot 1810. Snap insert receiver 1825 provides for the snap fit of microlight 1740.

Figure 19:
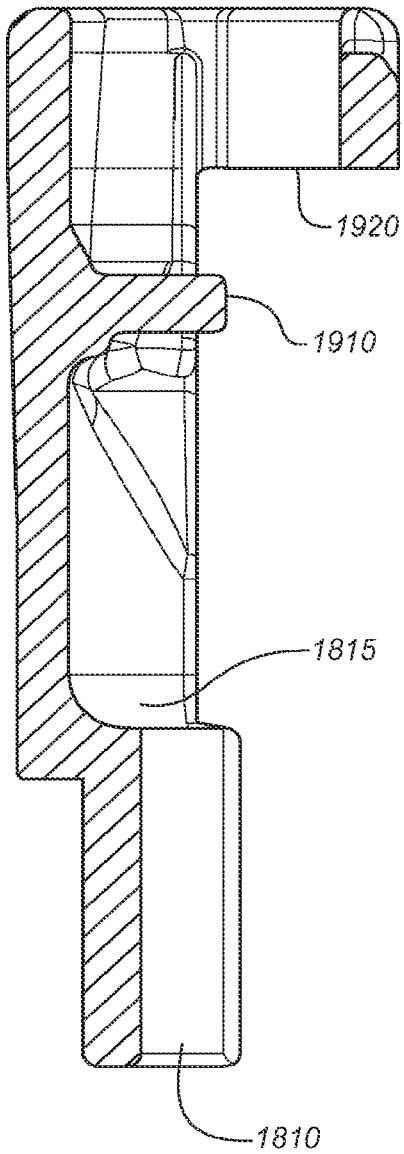
FIG. 19 shows a cross section of one-half of the connection device of the lighting device of FIG. 17.

FIG. 19 shows a cross section of one-half of the connection device of the lighting device of FIG. 17. Here, the opening 1920 for receiving the other half of the connection device is clear. The slot 1815 is shown, defined by ridge 1910 and slot 1810.

Figure 20A:
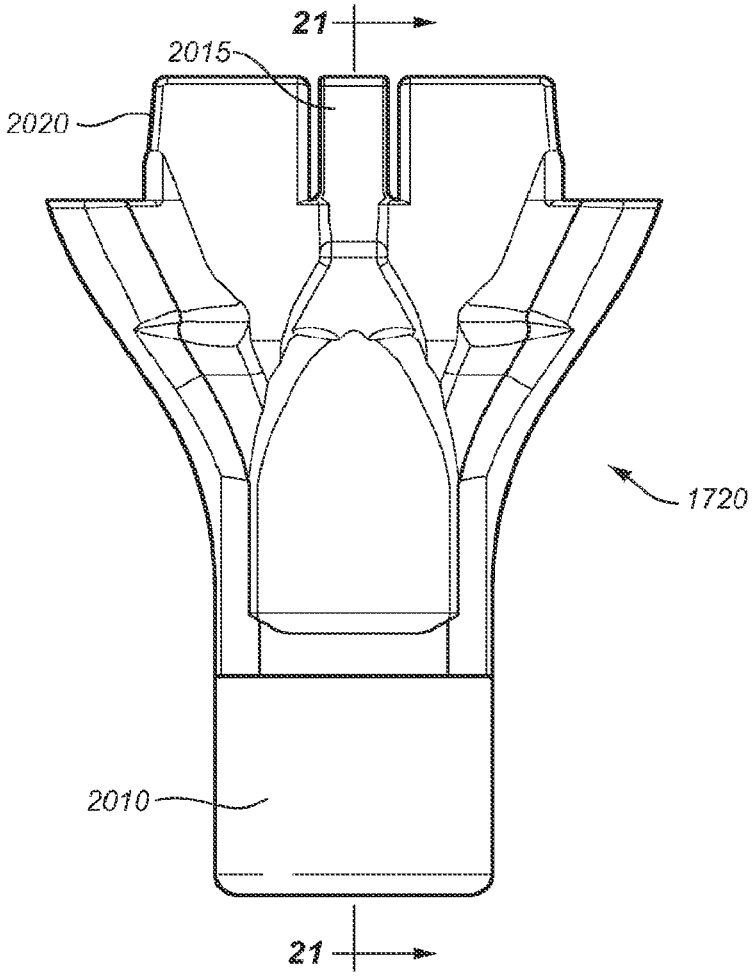
FIG. 20A shows a side view of the other half of a connection device of the lighting device of FIG. 17.
Figure 20B:
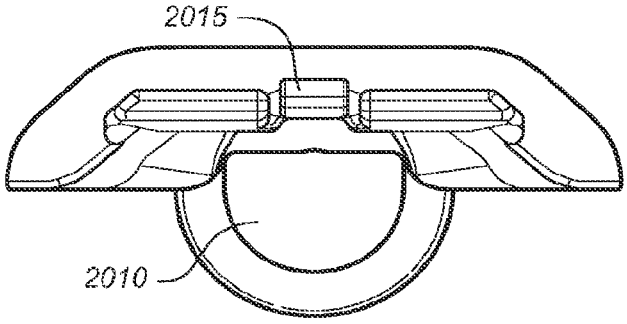
FIG. 20B shows a front view of the other half of the connection device of the lighting device of FIG. 17.
Figure 21:
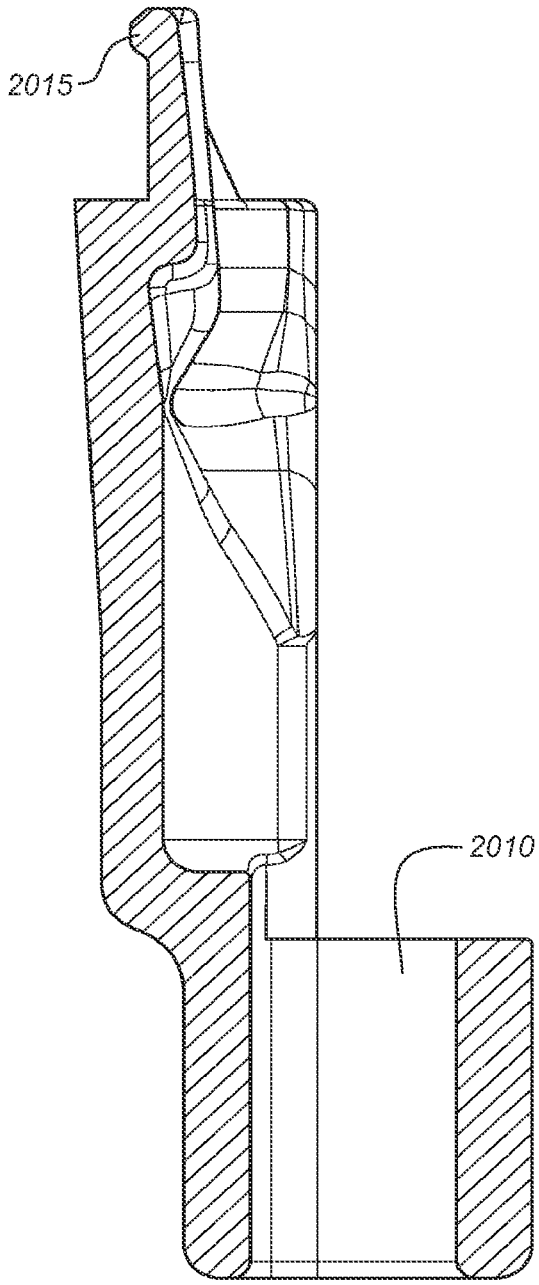
FIG. 21 shows a cross section of the other half of the connection device of the lighting device of FIG. 17.

FIG. 20A shows a side view of the other half 1720 of a connection device of the lighting device of FIG. 17. First attachment 1720 includes a snap fit tab 2015 having a lip that fits into snap insert receiver 1825, which is a slot having a receiver for the tab and the lip such that the tab bends and snaps into place with the lip holding it there. The outer connection portion 2020 provides for a mated fit into the open end 1820. End 2010 is sized to mate with and fit over slot 1810. FIG. 20B shows a front view of the other half of the connection device of the lighting device of FIG. 17. FIG. 21 shows a cross section of the other half of the connection device of the lighting device of FIG. 17. Here the lip on the snap fit tab 2015 is clearly visible.

Figure 22:
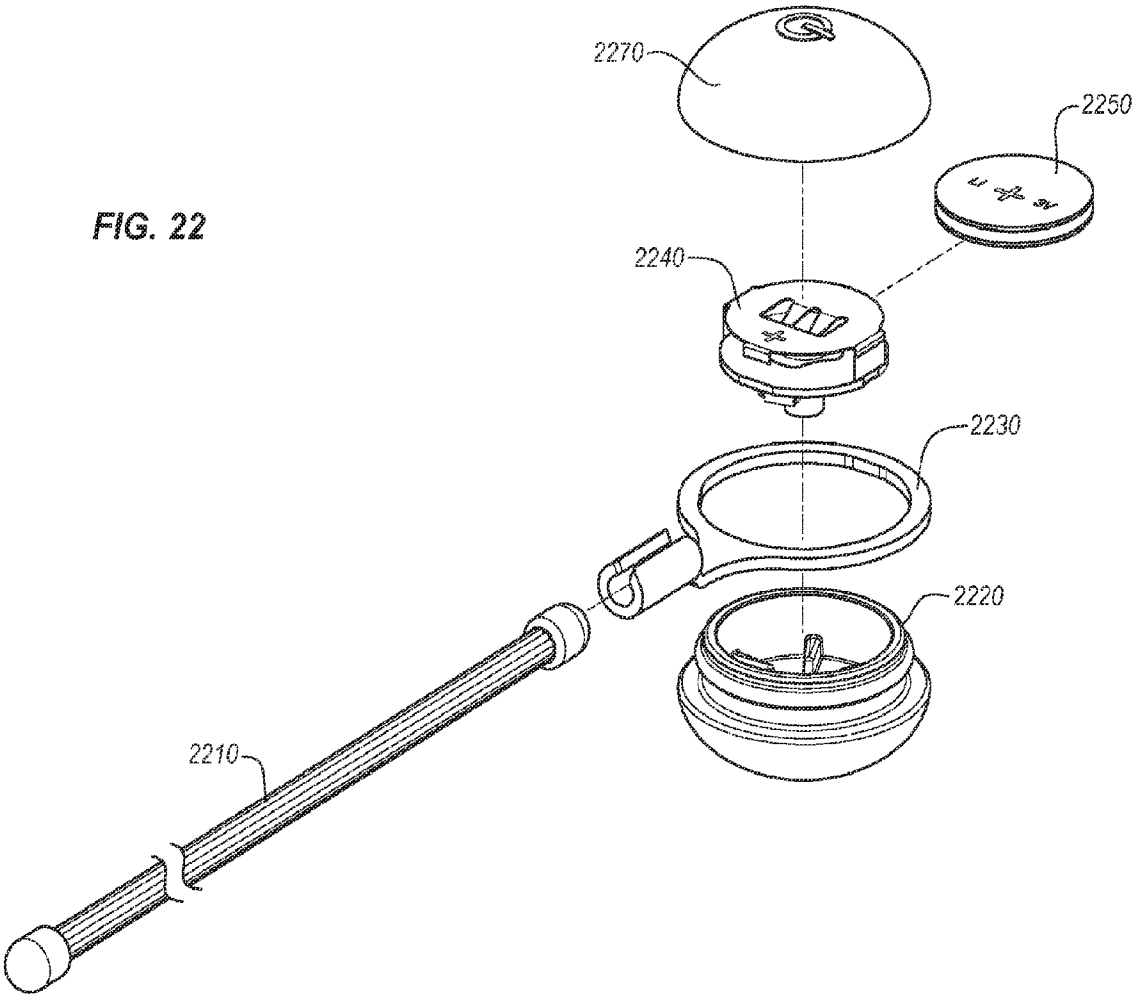
FIG. 22 shows an exploded top perspective view of one embodiment of a lighting device.

FIG. 22 shows an exploded top perspective view of one embodiment of a lighting device. This lighting device includes a twist tie 2210 as described herein. A connector 2230 having a narrowed end attachment for receiving twist tie 2210 provides for attachment into a lighting mechanism which includes top and bottom cover 2270, 2220, a lighting mechanism, and battery which all fit together. The lighting mechanism described in U.S. Pat. No. 7,683,275 may be used in this configuration and is incorporated by reference herein.

While specific embodiments have been described in detail in the foregoing detailed description and illustrated in the accompanying drawings, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein, but is intended to cover modifications within the spirit and scope thereof as defined by the appended claims and any and all equivalents thereof. Note that, although particular embodiments are shown, features of each attachment may be interchanged between embodiments.

What is claimed as new and desired to be protected by Letters Patent of the United States is:

1. A holder comprising:

(a) a body;

(b) a cylindrical holder interconnected with the body; and (c) a tie comprised of an elongated piece of shape-retaining deformable material and a cover covering said shape-retaining deformable material along a length of said elongated piece; said covering and said shape-retaining deformable material being bonded along their length; the tie located in the cylindrical holder; and the cylindrical holder having a first circular cross-section approximately equal to a second circular cross-section of the tie, wherein the cylindrical holder includes an aperture along a length of the cylindrical holder with the aperture more narrow than a width of the tie, such that, when compressed, the tie is movable through the aperture releasing it from the cylindrical holder, wherein a plurality of cylindrical holders are attached to the body, the cylindrical holder being one of the plurality of cylindrical holders.

2. The holder of claim 1 wherein the body includes a connection mechanism for attaching to another object.

* * * * *